US010324414B2

(12) United States Patent
Minamikawa et al.

(10) Patent No.: US 10,324,414 B2
(45) **Date of Patent: *Jun. 18, 2019**

(54) IMAGE FORMING DEVICE CAPABLE OF INSERTION AND PULLING-OUT CONSUMABLE ARTICLE CONTAINER

(71) Applicant: Sharp Kabushiki Kaisha, Sakai, Osaka (JP)

(72) Inventors: Tomoki Minamikawa, Sakai (JP); Hiroo Naoi, Sakai (JP)

(73) Assignee: SHARP KABUSHIKI KAISHA, Sakai (JP)

( * ) Notice: Subject to any disclaimer, the term of this patent is extended or adjusted under 35 U.S.C. 154(b) by 0 days.

This patent is subject to a terminal disclaimer.

(21) Appl. No.: 16/010,545

(22) Filed: Jun. 18, 2018

(65) Prior Publication Data

US 2018/0299820 A1 Oct. 18, 2018

Related U.S. Application Data

(63) Continuation of application No. 15/593,500, filed on May 12, 2017, now Pat. No. 10,031,469.

(30) Foreign Application Priority Data

Jun. 8, 2016 (JP) ..... 2016-114349

(51) Int. Cl.

| | |
|---|---|
| ***G03G 15/00*** | (2006.01) |
| ***G03G 15/08*** | (2006.01) |
| ***G03G 21/16*** | (2006.01) |

(52) U.S. Cl.

CPC ..... *G03G 21/1647* (2013.01); *G03G 15/0863* (2013.01); *G03G 15/50* (2013.01); *G03G 15/0875* (2013.01)

(58) Field of Classification Search

CPC ..... G03G 21/1647; G03G 15/50; G03G 15/0863; G03G 15/0875

USPC ..... 399/24

See application file for complete search history.

(56) References Cited

U.S. PATENT DOCUMENTS

2015/0139698 A1* 5/2015 Leemhuis ..... G03G 15/0865 399/258

OTHER PUBLICATIONS

Minamikawa et al., "Image Forming Device Capable of Inserting/Pulling-Out Consumable Article Container", U.S. Appl. No. 15/593,500, filed May 12, 2017.

* cited by examiner

*Primary Examiner* — Susan S Lee

(74) *Attorney, Agent, or Firm* — Keating & Bennett, LLP

(57) ABSTRACT

An image forming device includes a toner cartridge which is housed in a cartridge housing portion, and a pushing-out unit, and the toner cartridge includes a CRUM chip. The CRUM chip stores specific information about whether the toner cartridge can be extracted at a housed position where the toner cartridge is housed in the cartridge housing portion. The pushing-out unit pushes-out the toner cartridge in a direction that the toner cartridge can be extracted from the cartridge housing portion in a case where the specific information indicates that the toner cartridge cannot be extracted at the housed position.

9 Claims, 10 Drawing Sheets

IMAGE FORMING DEVICE CAPABLE OF INSERTION AND PULLING-OUT CONSUMABLE ARTICLE CONTAINER

BACKGROUND

1. Field

The present disclosure relates to an image forming device, and particularly relates to an image forming device that forms an image by using toner on paper, for example.

2. Description of the Related Art

An example of an image forming device in related art is disclosed in Japanese Unexamined Patent Application Publication No. 2013-029676. The image forming device of Japanese Unexamined Patent Application Publication No. 2013-029676 includes a toner cartridge moving unit that moves a toner cartridge from a toner refilling position in a housing portion to an extraction position on the outside in the horizontal direction. In the image forming device, in a case where toner in the toner cartridge runs out, for example, the toner cartridge is moved from the toner refilling position to the extraction position by the toner cartridge moving unit.

The image forming device in related art is configured on an assumption that the toner cartridge is moved by the toner cartridge moving unit. Meanwhile, there may be a case where it is desired to use a toner cartridge that is only manually extractable from the housing portion after the image forming device is on sale. However, in the image forming device in related art, because the toner cartridge that is only manually extractable may not be used and flexibility of product marketing is low, there is room for improvement.

SUMMARY

Accordingly, it is desirable to provide a novel image forming device.

It is also desirable to provide an image forming device that may enhance flexibility of product marketing of a toner cartridge.

An aspect of the present disclosure provides an image forming device that forms an image on paper by using a consumable article. The image forming device includes a consumable article container housing portion, a consumable article container, a pushing-out unit, a storage member, and a control unit. The consumable article container housing portion is provided to a device body of the image forming device. For example, an opening of the consumable article container housing portion is provided on a front surface side (front side) in a case where the device body is seen from a direct front. A consumable article container houses the consumable article in an internal portion of the consumable article container and is housed in the consumable article container housing portion so as to be capable of insertion and pulling-out. The consumable article is used for development and is toner, liquid toner, or ink, for example. The consumable article container is a toner container, a liquid toner container, or an ink container and is a toner cartridge, a toner bottle, an ink cartridge, an ink bottle, or the like, for example. The pushing-out unit pushes out the consumable article container from a housed position where the consumable article container is housed in the consumable article container housing portion in a direction in which the consumable article container is pulled out from the consumable article container housing portion. The storage member is provided in the consumable article container or the image forming device and stores specific information about whether a pushing-out action (ejection action) by the pushing-out unit for the consumable article container is permitted. For example, the storage member is a non-volatile memory such as a CRUM chip or an EEPROM®. The control unit acquires the specific information which is stored in the storage member and actuates the pushing-out unit in a case where the pushing-out action for the consumable article container is permitted.

DESCRIPTION OF THE EMBODIMENTS

[First Embodiment]

Figure 1:
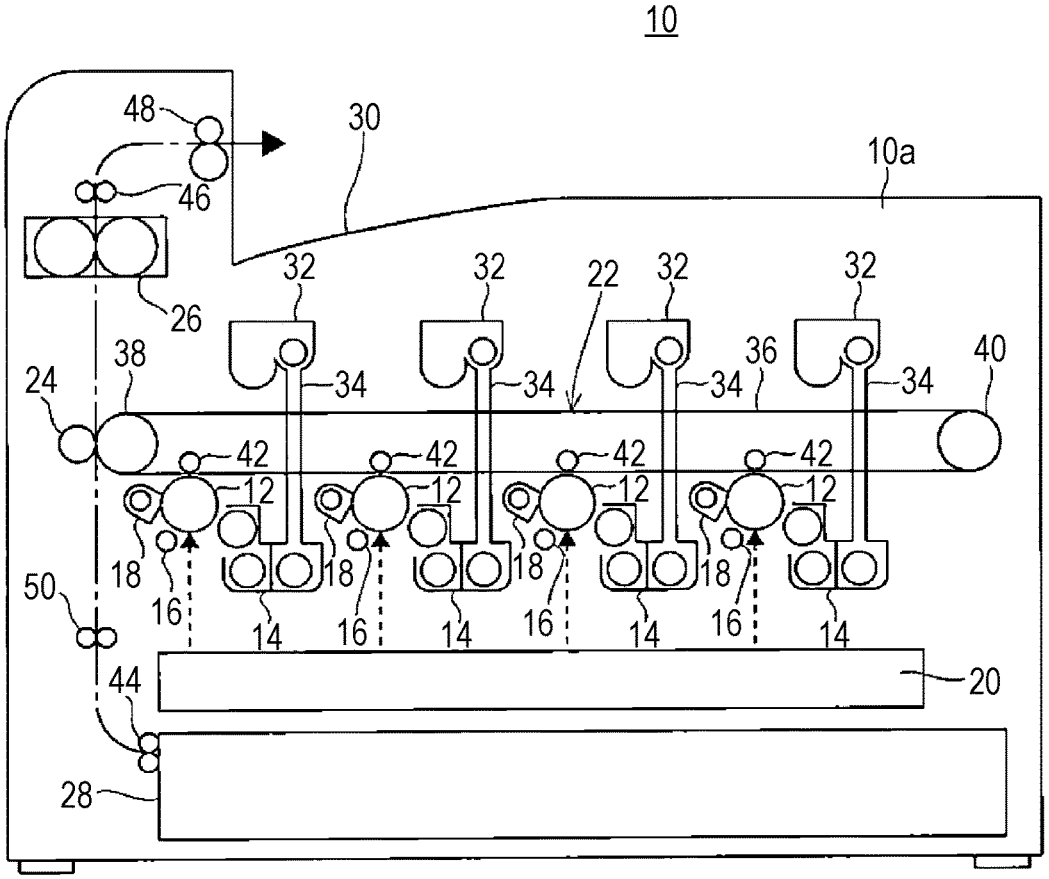
FIG. 1 is an explanatory diagram that illustrates an example of an outline of a general configuration of an image forming device of a first embodiment.

FIG. 1 is an outline configuration diagram of a whole image forming device 10 as one embodiment of the present disclosure as seen from a direct front.

Referring to FIG. 1, the image forming device 10 of the first embodiment is a color printer that forms an multi-colored or uni-colored image on paper (recording medium) by an electrophotographic scheme. The image forming device 10 may be a grayscale printer. Further, the image forming device 10 does not have to be limited to a printer but may be a copy machine, a facsimile, or a multi-function printer that includes functions of those.

First, an outline of a basic configuration of the image forming device 10 will be described. As illustrated in FIG.

1, the image forming device 10 includes components such as a photosensitive drum 12, a developing device 14, a charger 16, a cleaning unit 18, an exposure device 20, an intermediate transfer belt unit 22, a second transfer roller 24, and a fixing unit 26, forms an image on a piece of paper that is conveyed from a paper feeding tray 28, and discharges the piece of paper on which the image is formed to a paper output tray 30. As image data for forming an image on paper, image data that are input from an external computer are used. However, in a case where the image forming device 10 includes a scanner function, not only image data input from the outside but also image data that are read from a manuscript by the scanner may also be used.

Each of the above-described components is housed in a device body 10*a* of the image forming device 10. Further, a control portion, which includes a CPU, a memory, and so forth and is not illustrated, is provided in the device body 10*a* of the image forming device 10. The control portion transmits a control signal to each part of the image forming device 10 and causes the image forming device 10 to execute various actions.

Further, although not illustrated, an operating panel is provided on a front surface side of the device body 10*a*. The operating panel includes a display with a touch panel (touch panel display), plural operating buttons, and so forth. Software keys, messages, and so forth for receiving various settings, a print instruction, or the like from a user are displayed on the touch panel display. Further, the operating buttons include buttons that represent numbers of zero to nine for setting a magnification, for setting the number of printed copies, and for inputting a facsimile number, buttons for starting or stopping a job, and so forth. In the first embodiment, the job means copying (including scanning of the manuscript), printing, scanning, facsimile transmission, and so forth. Note that the software keys represent keys that are reproduced on a screen in a software manner. Meanwhile, hardware keys represent keys (buttons) that are provided as physical devices.

Here, image data that are dealt with in the image forming device 10 correspond to a color image that is formed with four colors of black (BK), magenta (M), cyan (C), and yellow (Y). Thus, four photosensitive drums 12, four developing devices 14, four chargers 16, and four cleaning units 18 are provided in order to form four kinds of latent images that correspond to the colors and configure four image stations. The four image stations are arranged to be aligned in one line along a traveling direction (revolving movement direction) of a surface of an intermediate transfer belt 36. The image stations for black, magenta, cyan, and yellow are arranged in this order from a downstream side in the traveling direction of the intermediate transfer belt 36, that is, from the closer side to the second transfer roller 24. The arrangement order of the colors may appropriately be changed.

In each of the image stations, the charger 16, the developing device 14, and the cleaning unit 18 are arranged in this order with respect to the rotational direction of the photosensitive drum 12 (counterclockwise in FIG. 1). The developing device 14 is arranged such that the rotational axis of a developing roller is aligned in parallel with the rotational axis of the photosensitive drum 12. Further, the charger 16 is arranged such that the rotational axis of the charger 16 is aligned in parallel with the rotational axis of the photosensitive drum 12. In addition, the cleaning unit 18 is arranged such that the longitudinal direction of a cleaning blade (not illustrated) matches the rotational axis direction of the photosensitive drum 12. Here, in FIG. 1, the rotational axis direction of the photosensitive drum 12 is the depth direction (front-rear direction) in a case where the image forming device 10 is seen from the direct front.

The photosensitive drum 12 is an image carrier in which a photosensitive layer (photoconductive layer) is formed on a surface of a base body with electric conductivity and is rotatably supported by a driving portion, which is not illustrated. The base body may employ various shapes such as a cylindrical shape, a columnar shape, and a thin-film sheet shape. The photosensitive layer is formed of a material that is irradiated with light and thereby exhibits electric conductivity. As the photosensitive drum 12 of the first embodiment, a photosensitive drum that includes a cylindrical base body formed of aluminum and a photosensitive layer which is formed on an outer peripheral surface of the base body and formed of amorphous silicon (a-Si), selenium (Se), or an organic photoconductor (OPC) is used.

The developing device 14 visualizes (forms a toner image) an electrostatic latent image formed on the surface of the photosensitive drum 12 by a consumable article (toner). The developing device 14 is connected with a toner cartridge (consumable article container) 32 via a toner supply pipe 34. The toner cartridge 32 is a container that stocks unused toner and carrier, is provided above the developing device 14, supplies (refills) the toner to the developing device 14, and refills the carrier. The toner supply pipe 34 couples (connects) the toner cartridge 32 with a toner refilling port (not illustrated) that is formed in the developing device 14. Details of the toner cartridge 32 will later be described.

The charger 16 is a device that electrically charges the surface of the photosensitive drum 12 with prescribed polarity and electric potential. As the charger 16, a brush type charging device, a roller type charging device, a corona discharge device, an ion generator, or the like may be used.

The cleaning unit 18 removes and collects remaining toner on the surface of the photosensitive drum 12 after the toner image is transferred from the photosensitive drum 12 to the intermediate transfer belt 36 and purifies the surface of the photosensitive drum 12. Accordingly, for example, the cleaning unit 18 includes the cleaning blade as a plate-shaped member for scraping the toner and a collecting container for collecting the scraped toner.

The exposure device 20 is provided below the developing device 14. The exposure device 20 is configured as a laser scanning unit (LSU) that includes a laser emitting portion, a reflection mirror, and so forth, exposes the electrically charged surface of the photosensitive drum 12 to light, and thereby forms the electrostatic latent image that corresponds to the image data on the surface of the photosensitive drum 12.

The intermediate transfer belt unit 22 includes the intermediate transfer belt 36, a driving roller 38, a driven roller 40, four intermediate transfer rollers (first transfer rollers) 42, and so forth and is arranged above the photosensitive drum 12.

The intermediate transfer belt 36 is an endless belt with flexibility and is formed of a synthetic resin, rubber, or the like that is appropriately combined with an electrically conductive material such as carbon black. The intermediate transfer belt 36 is stretched by plural rollers such as the driving roller 38 and the driven roller 40 and is arranged such that a surface (outer peripheral surface) of the intermediate transfer belt 36 abuts the surface of the photosensitive drum 12. Further, the intermediate transfer belt 36 rotates (performs revolving movement) in a prescribed direction (clockwise in FIG. 1) in response to rotational driving of the driving roller 38.

The driving roller 38 is provided around the axial line thereof rotatably by a driving portion, which is not illustrated. The driven roller 40 rotates in response to the revolving movement of the intermediate transfer belt 36 and adds a regular tension to the intermediate transfer belt 36, and thereby avoids loosening of the intermediate transfer belt 36.

The intermediate transfer rollers 42 are arranged in positions opposed to the respective photosensitive drums 12 across the intermediate transfer belt 36, are brought into pressure contact with an inner peripheral surface of the intermediate transfer belt 36, and rotate in response to the revolving movement of the intermediate transfer belt 36. Although not illustrated, the intermediate transfer roller 42 is connected with a transfer power source that applies a transfer bias. In a case of image formation, a voltage of the reverse polarity to the charge polarity of the toner that configures the toner image formed on the surface of the photosensitive drum 12 is applied to the intermediate transfer roller 42. Consequently, a transfer electric field is formed between the photosensitive drum 12 and the intermediate transfer belt 36, and the toner image formed on the photosensitive drum 12 is transferred to the outer peripheral surface of the intermediate transfer belt 36 by work of the transfer electric field. For example, in a case where a color image is formed, the toner images in the colors that are formed on the respective photosensitive drums 12 are sequentially transferred (first transfer) to the intermediate transfer belt 36 in a superposing manner, and a multi-colored toner image is thereby formed on the outer peripheral surface of the intermediate transfer belt 36.

Further, the second transfer roller 24 is arranged in a position opposed to the driving roller 38 across the intermediate transfer belt 36. The second transfer roller 24 is connected with a transfer power source, which is not illustrated. In a case of image formation, a voltage (second transfer voltage) is applied to the second transfer roller 24 by the transfer power source. Then, while a piece of paper passes through a transfer nip area between the intermediate transfer belt 36 and the second transfer roller 24, the toner image formed on the outer peripheral surface of the intermediate transfer belt 36 is transferred (second transfer) to the piece of paper by the work of the transfer electric field formed by the second transfer roller 24 to which the voltage is applied. Subsequently, the remaining toner on the surface of the intermediate transfer belt 36 is removed and collected by a transfer belt cleaning unit, which is not illustrated.

The fixing unit 26 includes a heat roller, a pressure roller, and so forth and is arranged above the second transfer roller 24. The heat roller is set to become a prescribed fixing temperature, a piece of paper passes through a fixing nip area between the heat roller and the pressure roller, the toner image transferred to the piece of paper is thereby melted, mixed, and brought into pressure contact, and heat fixing of the toner image to the piece of paper is performed.

Further, in the device body 10*a* of the image forming device 10, a paper conveyance path for delivering a piece of paper placed on the paper feeding tray 28 to the paper output tray 30 via the second transfer roller 24 and the fixing unit 26 is formed. Paper conveyance units such as conveyance rollers 44, 46, and 48 and resist rollers 50 are appropriately arranged in the paper conveyance path.

In a case of image formation, a piece of paper placed on the paper feeding tray 28 is piece by piece guided to the paper conveyance path by a pick-up roller, which is not illustrated, and is conveyed to the resist rollers 50 by the conveyance rollers 44. Then, the piece of paper is conveyed to the second transfer roller 24 by the resist rollers 50 at the timing when a tip of the piece of paper corresponds with a tip of the toner image on the intermediate transfer belt 36, and the toner image is transferred onto the piece of paper. Subsequently, the piece of paper passes through the fixing unit 26, unfixed toner on the piece of paper is melted by heat and adhered, and the piece of paper is discharged onto the paper output tray 30 via the conveyance rollers 46 and 48.

Figure 2:
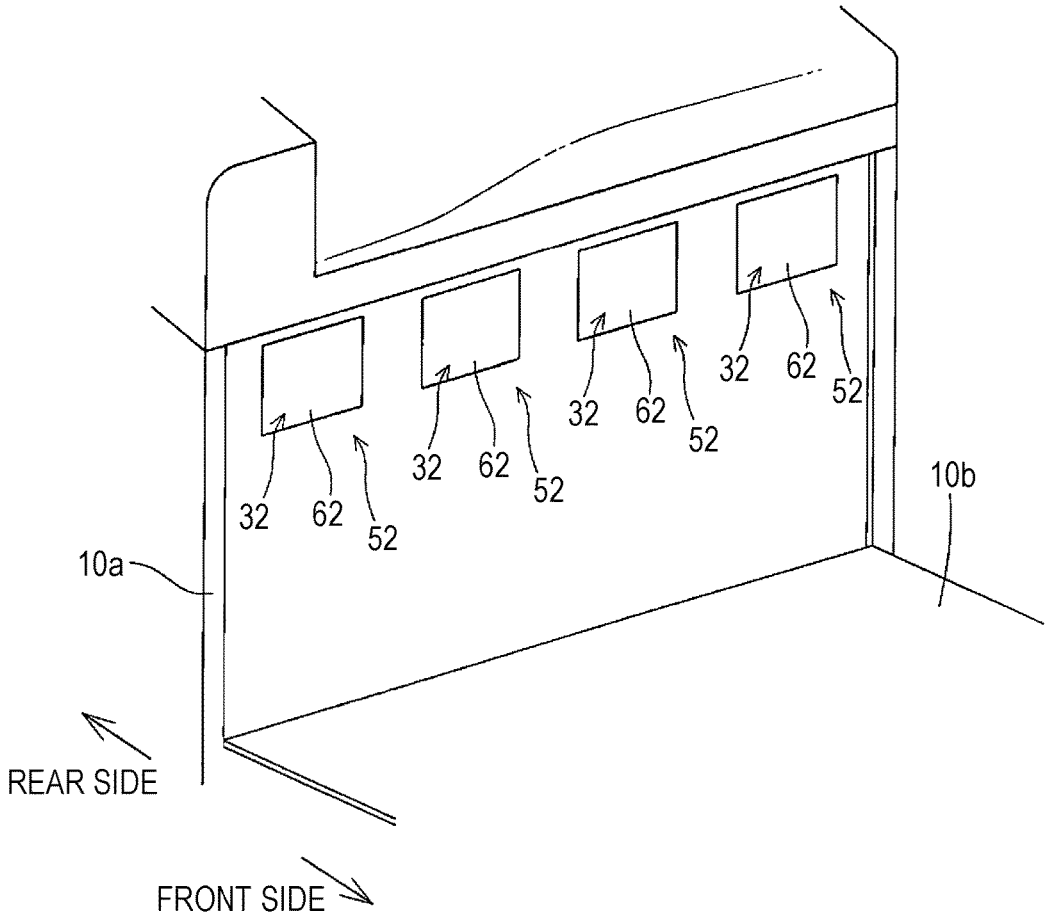
FIG. 2 is an explanatory diagram that illustrates a state where all toner cartridges are housed in a device body.

Next, a description will be made about the toner cartridge 32 and a cartridge housing portion 52 of the first embodiment. FIG. 2 illustrates a state where all the toner cartridges 32 are housed in the cartridge housing portions 52 (device body 10*a*).

As illustrated in FIG. 2, the device body 10*a* is provided with four consumable article container housing portions (cartridge housing portions) 52 that correspond to the four toner cartridges 32. The corresponding toner cartridge 32 is housed (installed) in each of the four cartridge housing portions 52 so as to be capable of insertion and pulling-out. For example, an opening 52*a* of the cartridge housing portion 52 is provided on the front surface side (front side) in a case where the image forming device 10 is seen from the direct front.

The toner cartridge 32 is inserted in the cartridge housing portion 52 from the opening 52*a* toward a back surface side (rear side). Further, the toner cartridge 32 is pulled out (extracted) to the front side in a case of removal.

Further, the device body 10*a* has a lid 10*b* that is provided to be capable of opening and closing. The lid 10*b* is provided to cover a front surface side of the four cartridge housing portions 52 in a closed state. Further, in a state where the lid 10*b* is opened, the openings 52*a* of the cartridge housing portions 52 and the housed toner cartridges 32 are exposed to the outside. A front cover 62 that is provided in an end portion on the front side of the toner cartridge 32 is exposed from the opening 52*a* of the cartridge housing portion 52.

In the description made below, in a case where directions are described herein, the front surface side in a case where the image forming device 10 is seen from the direct front will be referred to "front side", the back surface side will be referred to "rear side", a left surface side will be referred to as "left side", a right surface side will be referred to as "right side", an upper surface (top surface) side will be referred to as "upper side", and a lower surface (bottom surface) side will be referred to as "lower side". Further, in a case where the toner cartridge 32 is described, the directions in the state where the toner cartridge 32 is inserted in the image forming device 10 will be used.

Figure 3:
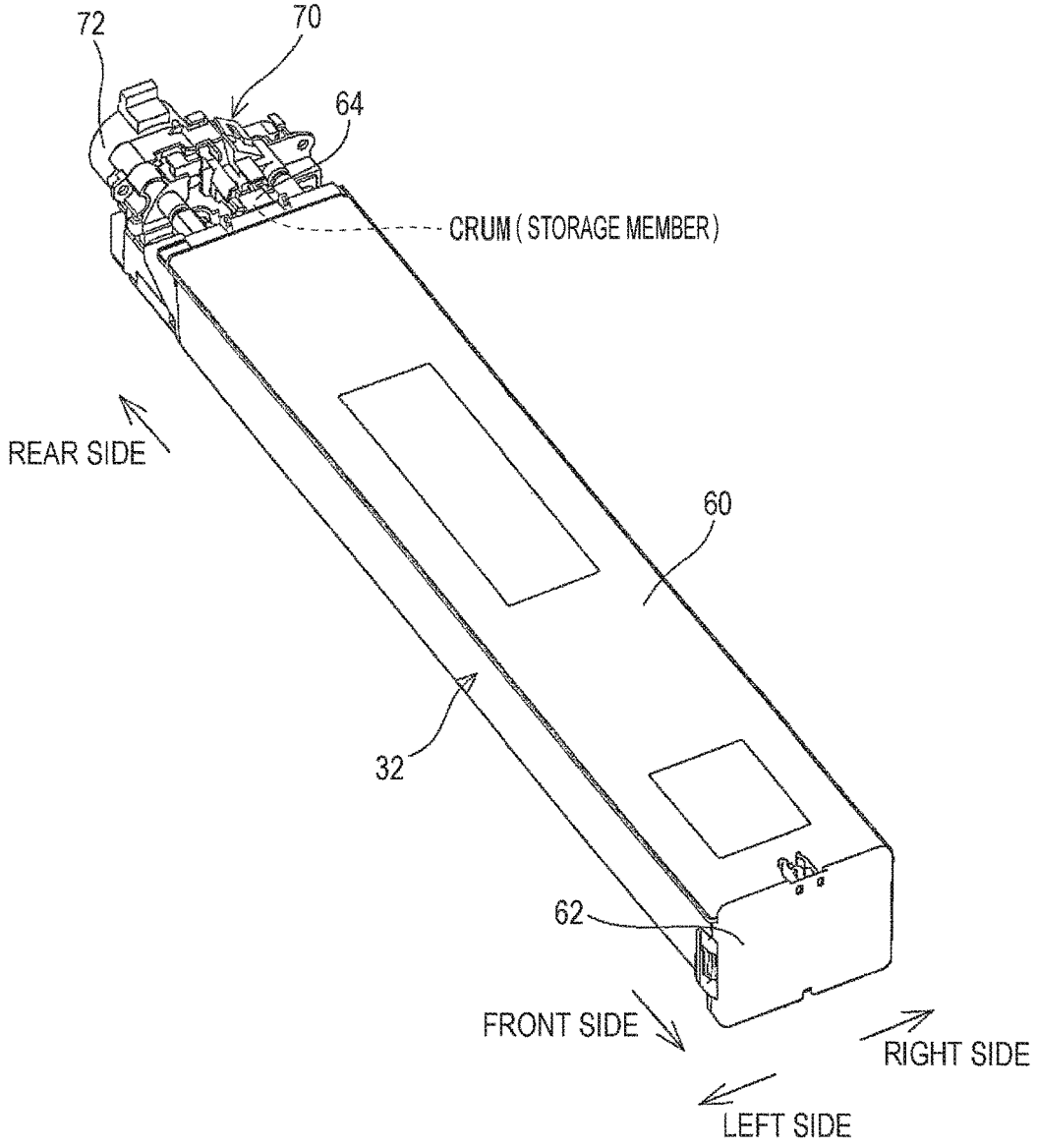
FIG. 3 is a perspective diagram that illustrates an external configuration of a toner cartridge and a driving unit.
Figure 4A:
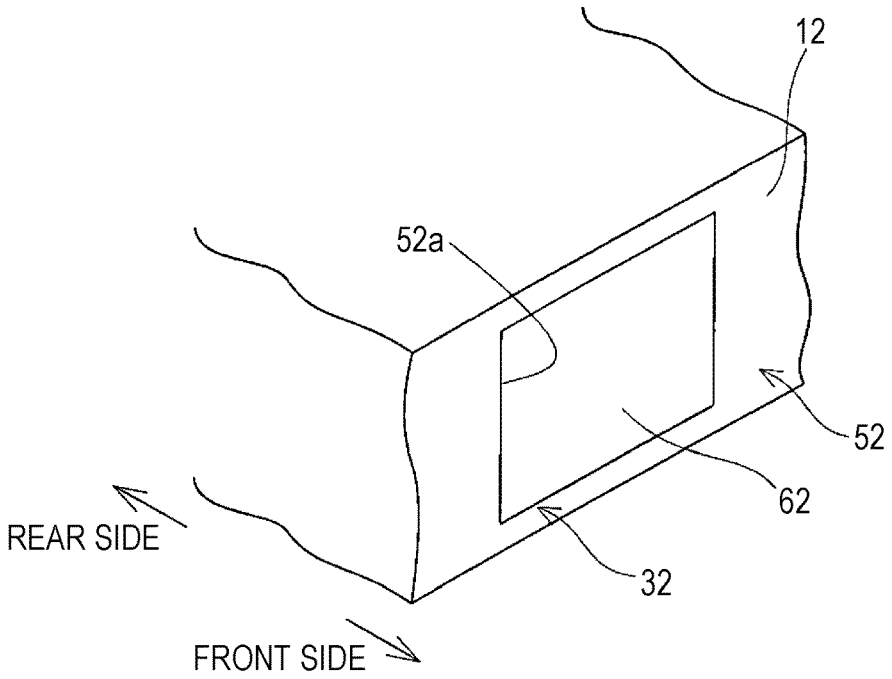
FIG. 4A is an explanatory diagram that illustrates a state where the toner cartridge is in a housed position.
Figure 4B:
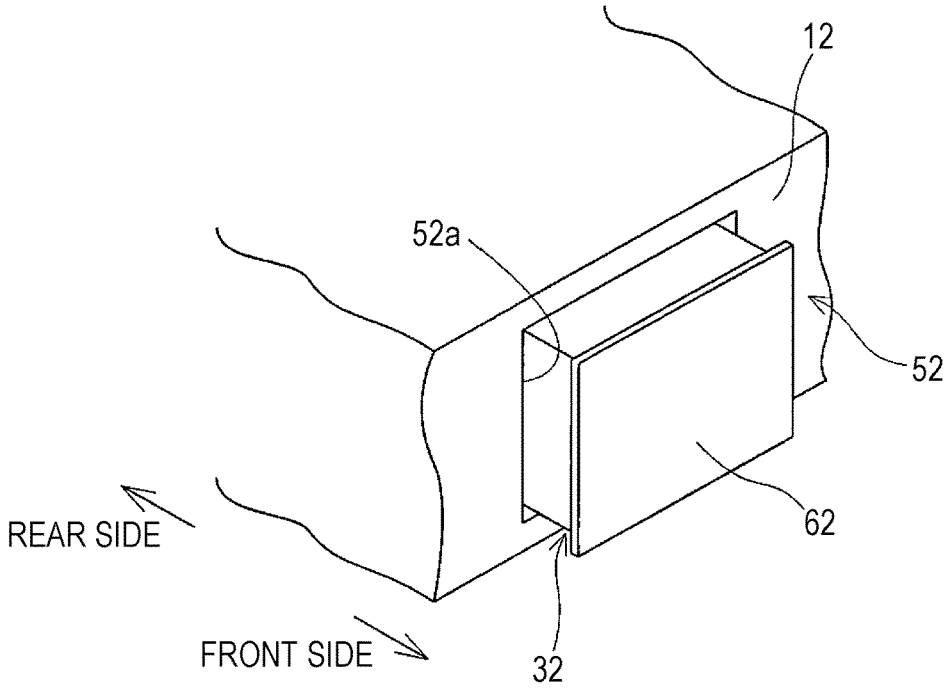
FIG. 4B is an explanatory diagram that illustrates a state where the toner cartridge is in an extractable position.

FIG. 3 is a perspective diagram that illustrates an external configuration of the toner cartridge 32 and a driving unit 70 which is provided in an internal portion of the image forming device 10. FIG. 4A is an explanatory diagram that illustrates a state where the toner cartridge 32 is in a housed position. FIG. 4B is an explanatory diagram that illustrates a state where the toner cartridge 32 is in an extractable position.

As illustrated in FIG. 3, the toner cartridge 32 includes a container body 60, the front cover 62, and a connector 64.

The container body 60 is a longitudinally tubular container that has a rectangular cross section and extends in the front-rear direction, and the toner is housed in an internal portion of the container body 60. Although not illustrated, in the internal portion of the container body 60, an auger screw that functions as a toner conveyance member, a stirring member that stirs the toner in the container body 60 so as to cause the toner to be dissolved and supplies the toner to the auger screw, and so forth are provided.

Further, although not illustrated, a discharge port is formed in a rear side end portion of the container body 60. Note that the container body 60 may be in another shape such as a cylindrical shape.

As described above, the front cover 62 is provided in the end portion on the front side of the container body 60 (toner cartridge 32). The front cover 62 functions as a lid portion that blocks an opening on the front side of the container body 60. Further, the end portion on the front side of the toner cartridge 32 that includes the front cover 62 functions as a gripping portion to be gripped by the user in a case where the user extracts the toner cartridge 32 from the cartridge housing portion 52.

Further, the connector (hereinafter referred to as "cartridge side connector") 64 is provided in the rear side end portion of the container body 60. Although not illustrated, the cartridge side connector 64 is provided with a terminal to electrically connect with the control portion of the image forming device 10, and the terminal is electrically connected with a CRUM chip (storage member) that is provided to the toner cartridge 32. For example, the CRUM chip is provided in an internal portion or the like of a socket of the cartridge side connector 64.

Further, in a case where the toner cartridge 32 is housed in the cartridge housing portion 52, the cartridge side connector 64 is connected with a connector (hereinafter referred to as "body side connector") that is provided in the device body 10*a* (cartridge housing portion 52). The body side connector is provided with a terminal that is electrically connected with the control portion. The cartridge side connector 64 is connected with the body side connector, and the terminals thereby contact with each other. Accordingly, the CRUM chip is electrically connected with the control portion of the image forming device 10.

The CRUM chip stores device type information that indicates the device type of the image forming device 10 which employs the toner cartridge 32, identification information of the toner cartridge 32, information for managing toner refilling, and so forth. The device type information of the image forming device 10, the identification information of the toner cartridge 32, and so forth that are stored in the CRUM chip are stored when the toner cartridge 32 is manufactured.

Note that in the first embodiment, a description is made about a case where the CRUM chip is used as one example of the storage member. However, embodiments do not have to be limited to this. As the storage member, another non-volatile memory such as an EEPROM® may be used.

Further, in a case where the toner cartridge 32 is in the housed position, the discharge port formed in the container body 60 is coupled with the toner supply pipe 34, and the toner discharged from the discharge port is refilled in the developing device 14 via the toner supply pipe 34. That is, the toner cartridge 32 becomes a usable state. Here, the housed position is a position where the toner cartridge 32 is on the rearmost side in a state where the toner cartridge 32 is inserted in the cartridge housing portion 52 and a position where the toner cartridge 32 may not further be moved to the rear side.

As illustrated in FIG. 4A, in a case where the toner cartridge 32 is in the housed position, the position of a front surface of the front cover 62 is the same as the opening 52*a* of the cartridge housing portion 52 in the front-rear direction or on the rear side of the opening 52*a* of the cartridge housing portion 52. Thus, in a case where the toner cartridge 32 is in the housed position, the user may not grip the toner cartridge 32 or the end portion on the front side of the toner cartridge 32. Accordingly, the toner cartridge 32 in the housed position is not extracted from the cartridge housing portion 52, or extraction is difficult.

Meanwhile, as illustrated in FIG. 4B, in a case where the toner cartridge 32 is on the front side of the housed position, the end portion on the front side of the toner cartridge 32 protrudes to the front side of the opening 52*a* of the cartridge housing portion 52. In this case, the user may grip the end portion on the front side of the toner cartridge 32. The position of the toner cartridge 32 in this case will be referred to as an extractable position. For example, the extractable position is a position where the toner cartridge 32 moves to the front side by approximately 15 to 20 mm from the housed position. That is, the end portion on the front side of the toner cartridge 32 protrudes to the front side by approximately 15 to 20 mm from the opening 52*a* of the cartridge housing portion 52.

The driving unit 70 illustrated in FIG. 3 is provided in the internal portion of the image forming device 10 and on a deep side (rear side) of the cartridge housing portion 52. The toner cartridge 32 and the driving unit 70 are coupled together in a case where the toner cartridge 32 is moved to the housed position.

Figure 5:
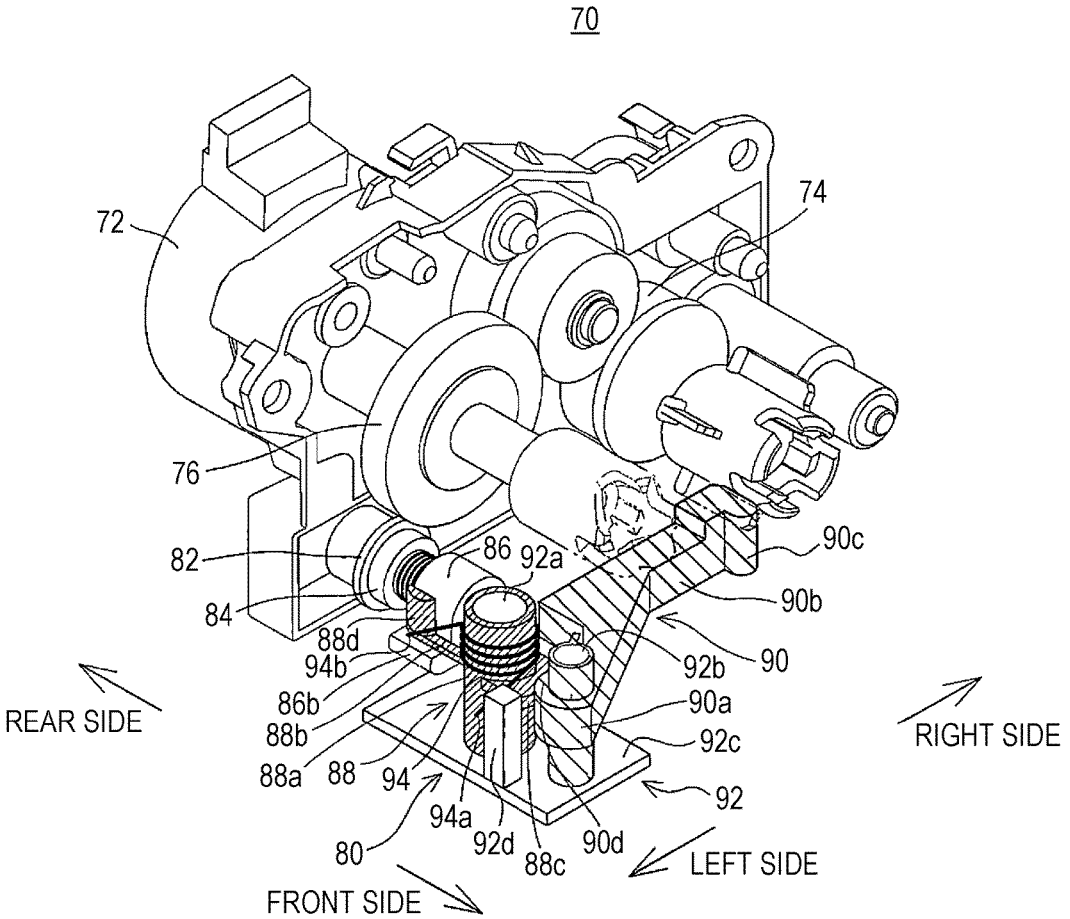
FIG. 5 is a perspective diagram that illustrates a configuration of the driving unit.

FIG. 5 is a perspective diagram that illustrates a configuration of the driving unit 70. However, in FIG. 5, a part of a cover on an upper side of the driving unit 70 is not illustrated. The driving unit 70 includes a motor 72, a drive transmission member 74, a drive transmission member 76, and an ejection mechanism (corresponding to a pushing-out unit) 80.

The motor 72 is capable of being switched between forward rotation (for example, clockwise rotation) and reverse rotation (for example, counterclockwise rotation). The rotational direction of the motor 72 is switched by an instruction by the control portion (CPU) of the image forming device 10.

Each of the drive transmission member 74 and the drive transmission member 76 is a member that transmits a rotational driving force of the motor 72 as a drive source to the auger screw and the stirring member which are provided in the internal portion of the toner cartridge 32. The drive transmission member 74 and the drive transmission member 76 are provided on a front side of the motor 72. The rotational axis directions of the drive transmission member 74 and the drive transmission member 76 are the front-rear direction.

In a case where the toner cartridge 32 and the driving unit 70 are coupled together, the drive transmission member 74 is coupled with the auger screw of the toner cartridge 32. Further, in a case where the toner cartridge 32 and the driving unit 70 are coupled together, the drive transmission member 76 is coupled with the stirring member of the toner cartridge 32.

Accordingly, in a case where the toner cartridge 32 and the driving unit 70 are coupled together, the rotational driving force of the motor 72 is transmitted to the auger screw via the drive transmission member 74 and is transmitted to the stirring member via the drive transmission member 76. Thus, the auger screw is rotated by the rotational driving force that is transmitted from the drive transmission member 74. Further, the stirring member is rotated by the rotational driving force that is transmitted from the drive transmission member 76.

Further, the rotational driving force is transmitted to the drive transmission member 74 and the drive transmission member 76 regardless of the rotational direction of the motor 72. However, the auger screw conveys developer in a prescribed conveyance direction in a case where the motor 72 is rotated forward. That is, a usual toner conveyance action is performed.

In a case where the usual toner conveyance action is performed, the motor 72 is rotated forward. In a case where the auger screw and the stirring member are rotated, the toner in the container body 60 is conveyed toward the rear side while being stirred. Accordingly, the toner is conveyed toward the discharge port formed in the rear side end portion in the container body 60 and is supplied to the developing device 14 via the toner supply pipe 34.

Meanwhile, only in a case where the motor 72 rotates reversely, an ejection mechanism 80 is actuated, and an ejection action is performed. The ejection mechanism 80 and the ejection action will specifically be described below.

Figure 6A:
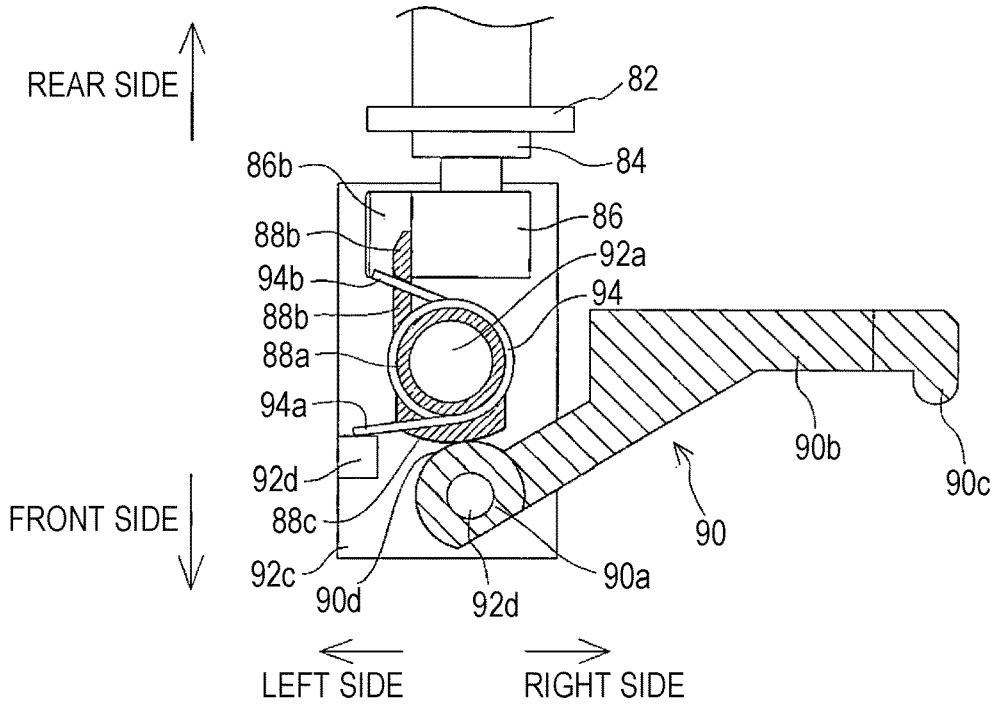
FIG. 6A is an explanatory diagram that illustrates a configuration of an ejection mechanism as seen from an upper side.
Figure 6B:
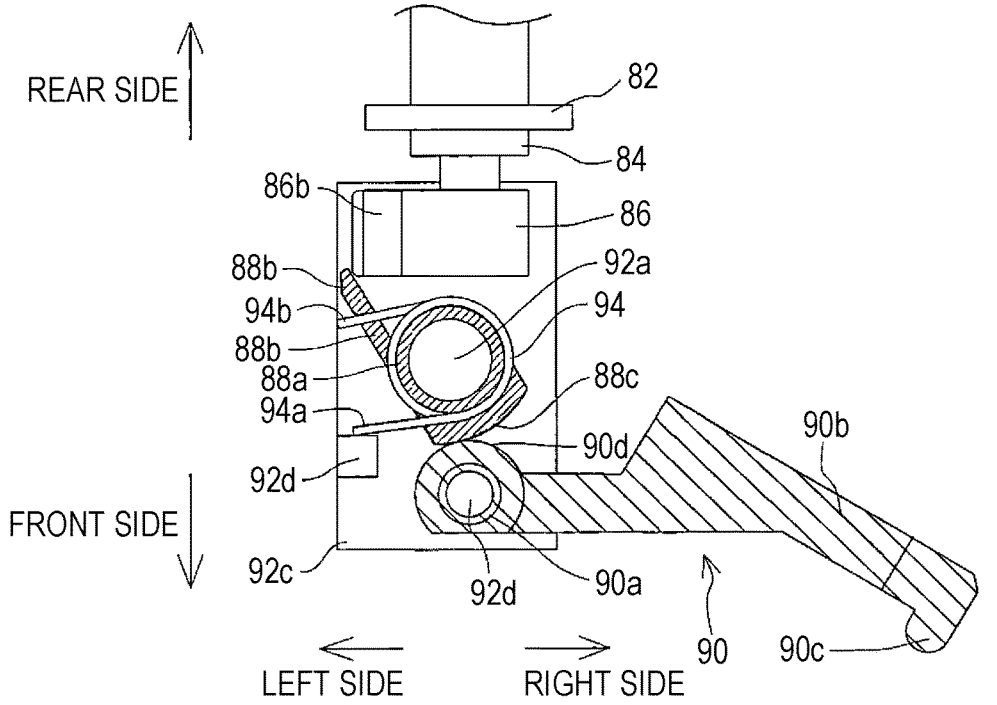
FIG. 6B is an explanatory diagram that illustrates the configuration of the ejection mechanism in an ejection state as seen from the upper side.

FIG. 6A and FIG. 6B are explanatory diagrams that illustrate a configuration of the ejection mechanism 80 as seen from the upper side. The ejection mechanism 80 is a mechanism for pushing out the toner cartridge 32 from the housed position to the extractable position. As illustrated in FIG. 5, FIG. 6A, and FIG. 6B, the ejection mechanism 80 includes a drive transmission member 82, a one-way clutch 84, an ejection cam 86, an ejection lever 88, an ejection arm 90, and a journal member 92, and a spring 94. Note that in FIG. 5, FIG. 6A, and FIG. 6B, for easy understanding of illustration, the ejection lever 88 and the ejection arm 90 are hatched. The same applies to FIG. 8. Further, although it is not very clear in FIG. 5, the ejection arm 90 is arranged on a lower side of a coupling gear of the drive transmission member 76.

The drive transmission member 82 is a member for transmitting the rotational driving force of the motor 72 to the ejection cam 86 and is coupled with the ejection cam 86 via the one-way clutch 84. Further, the drive transmission member 82 is provided on the front side of the motor 72. The rotational axis direction of the drive transmission member 82 is the front-rear direction. Further, the drive transmission member 82 rotates in the clockwise direction as seen from the front side in a case where the motor 72 of the driving unit 70 rotates forward. The drive transmission member 82 rotates in the counterclockwise direction as seen from the front side in a case where the motor 72 of the driving unit 70 rotates reversely. In addition, the rotational axis directions of the one-way clutch 84 and the ejection cam 86, which will be described later, are the front-rear direction. Further, the rotational axes of the drive transmission member 82, the one-way clutch 84, and the ejection cam 86 are coaxial with each other.

The one-way clutch 84 is provided between the drive transmission member 82 and the ejection cam 86. In the first embodiment, the one-way clutch 84 is arranged on a front side of the drive transmission member 82 and on a rear side of the ejection cam 86. The one-way clutch 84 transmits the rotational driving force transmitted from the drive transmission member 82 to the ejection cam 86 only in the case of a prescribed rotational direction. For example, in a case where the drive transmission member 82 is rotated in the clockwise direction as seen from the front side, the one-way clutch 84 does not transmit the rotational driving force to the ejection cam 86. That is, in a case where the motor 72 of the driving unit 70 is rotated forward, the one-way clutch 84 does not transmit the rotational driving force to the ejection cam 86. On the other hand, in a case where the drive transmission member 82 is rotated in the counterclockwise direction as seen from the front side, the one-way clutch 84 transmits the rotational driving force to the ejection cam 86. That is, in a case where the motor 72 of the driving unit 70 is rotated reversely, the one-way clutch 84 transmits the rotational driving force to the ejection cam 86.

Figure 7A:
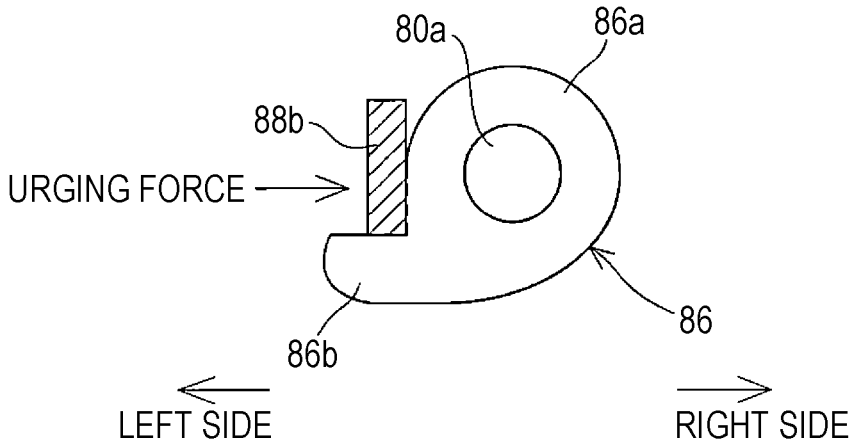
FIG. 7A is an explanatory diagram that illustrates a configuration of an ejection cam and an ejection lever as seen from a front side.

FIG. 7A is an explanatory diagram that illustrates a configuration of the ejection cam 86 and the ejection lever 88. As illustrated in FIG. 5, the ejection cam 86 is arranged on a front side of the one-way clutch 84. Further, as illustrated in FIG. 7A, the ejection cam 86 is a plane cam and is rotatably supported by a shaft member 80*a*. In addition, as described above, the ejection cam 86 is rotated by the rotational driving force that is transmitted from the one-way clutch 84. Furthermore, the ejection cam 86 includes a columnar base portion 86*a* and a protrusion portion 86*b* that protrudes in the tangential direction of an outer peripheral surface of the base portion 86*a* (a direction separating from the rotational axis of the ejection cam 86).

As illustrated in FIG. 5 and FIG. 6A, the ejection lever 88 is arranged between the ejection cam 86 and the ejection arm 90. More specifically, the ejection lever 88 is arranged on a front side of the ejection cam 86 and on a rear side of the ejection arm 90. The ejection lever 88 includes a shaft portion 88*a*, an arm portion 88*b*, and a gear 88*c*.

The shaft portion 88*a* is formed in a cylindrical shape that extends in the up-down direction. Further, the shaft portion 88*a* is pivotably supported by a columnar shaft 92*a* that is formed in the journal member 92 and extends in the up-down direction. Accordingly, the ejection lever 88 is provided to be pivotable around the axial line of the shaft 92*a* as the center in the horizontal plane.

The arm portion 88*b* is formed into a plate shape or a rod shape that extends to the rear side from the shaft portion 88*a*. An abutting portion 88*d* that abuts the ejection cam 86 is formed in an end portion (tip portion) on a rear side of the arm portion 88*b*. As illustrated in FIG. 5, FIG. 6A, and FIG. 7A, the abutting portion 88*d* is arranged on a left side of the ejection cam 86. Further, because the abutting portion 88*d* is present on a rear side when seen from the shaft portion 88*a*, the abutting portion 88*d* moves to the right side in a case where the ejection lever 88 pivots in the clockwise direction as seen from the upper side and moves to the left side in a case where the ejection lever 88 pivots in the counterclockwise direction as seen from the upper side.

The gear 88*c* is formed to swell out to the front side from a side peripheral surface of the shaft portion 88*a*. Further, as illustrated in FIG. 6A, the gear 88*c* is formed in an arc shape as seen from the upper side. The gear 88*c* is an externally toothed gear and meshes with a gear 90*d* of the ejection arm 90, which will be described later. However, in FIG. 5 and FIGS. 6A and 6B (similarly in FIG. 8), the shapes of teeth of the gear 88*c* (similarly for the gear 90*d*) are not illustrated.

As illustrated in FIG. 5 and FIG. 6A, the ejection arm 90 is arranged on a front side of the ejection lever 88. The ejection arm 90 includes a shaft portion 90*a*, an arm portion 90*b*, and the gear 90*d*.

The shaft portion 90*a* is formed in a cylindrical shape that extends in the up-down direction. Further, the shaft portion 90*a* is pivotably supported by a columnar shaft 92*b* that extends in the up-down direction of the journal member 92. Accordingly, the ejection arm 90 is provided to be pivotable around the axial line of the shaft 92*b* as the center in the horizontal plane. That is, the pivoting axis of the shaft portion 90*a* of the ejection arm 90 is parallel with the pivoting axis of the above-described shaft portion 88*a* of the ejection lever 88.

The arm portion 90*b* is integrally formed with the shaft portion 90*a* and extends to the right side from the shaft portion 90*a*. Further, an abutting portion 90*c* that protrudes to the front side is formed in an end portion (tip portion) on the right side of the arm portion 90*b*. The abutting portion 90*c* abuts an end portion on a rear side of the toner cartridge 32 from the rear side toward the front side. Further, because the abutting portion 90*c* is present on the right side when seen from the shaft portion 90*a*, the abutting portion 90*c* moves to the front side in a case where the ejection arm 90 pivots in the clockwise direction as seen from the upper side and moves to the rear side in a case where the ejection arm 90 pivots in the counterclockwise direction as seen from the upper side.

The gear 90*d* is formed to swell out to the rear side from a side peripheral surface of the shaft portion 90*a*. Further, the gear 90*d* is formed in an arc shape as seen from the upper side. The gear 90*d* is an externally toothed gear and meshes with the gear 88*c* of the ejection lever 88 as described above. Accordingly, a rotational force is transmitted from the ejection lever 88 to the ejection arm 90. The pivoting direction of the ejection arm 90 in a case where the rotational force is transmitted from the ejection lever 88 is an opposite direction to the pivoting direction of the ejection lever 88.

The journal member 92 includes the shaft 92*a*, the shaft 92*b*, a base portion 92*c*, and a support pillar 92*d*. Although not illustrated, the journal member 92 is fixed to the device body 10*a*.

The base portion 92*c* is a tabular member that is arranged on a lower side of the ejection cam 86, the ejection lever 88, the ejection arm 90, and so forth. Further, the base portion 92*c* is provided with the support pillar 92*d* in addition to the above-described shaft 92*a* and shaft 92*b*.

The support pillar 92*d* is a prism that extends in the up-down direction and is provided on a left side of the shaft portion 88*a* of the ejection lever 88 and the shaft portion 90*a* of the ejection arm 90.

The spring 94 is a torsion spring that is wound around the shaft portion 88*a* of the ejection lever 88 and has a first arm 94*a* and a second arm 94*b*. The first arm 94*a* abuts (elastically contacts with) a rear side surface of the support pillar 92*d* from the rear side toward the front side. The second arm 94*b* abuts (elastically contacts with) a left side surface or a front surface of the abutting portion 88*d* of the ejection lever 88 from the left side toward the right side. Accordingly, a restoring force of the spring 94 is exerted on the support pillar 92*d* and the abutting portion 88*d* of the ejection lever 88. Here, as described above, although the support pillar 92*d* is fixed to the device body 10*a* via the base portion 92*c*, the ejection lever 88 is pivotably provided. Accordingly, the restoring force of the spring 94 urges the ejection lever 88 (abutting portion 88*d*) in the clockwise direction as seen from the upper side. Thus, the abutting portion 88*d* of the ejection lever 88 receives the urging force of the spring 94 and abuts the ejection cam 86. The abutting portion 88*d* of the ejection lever 88 abuts the ejection cam 86, and the pivoting of the ejection lever 88 in the clockwise direction as seen from the upper side is thereby regulated.

Further, as described above, because the rotational direction of the ejection arm 90 is opposite to the rotational direction of the ejection lever 88, the urging force of the spring 94 is exerted on the ejection arm 90 in the counterclockwise direction as seen from the upper side. That is, the ejection arm 90 is urged by the spring 94 in a direction in which the abutting portion 90*c* separates from the toner cartridge 32.

The configuration of the ejection mechanism 80 has been described above. FIG. 5, FIG. 6A, and FIG. 7A illustrate a case where the ejection lever 88 and the ejection arm 90 are in reference states. Here, the reference state is a state where the abutting portion 88*d* of the ejection lever 88 is in the position to abut the base portion 86*a* of the ejection cam 86. Further, the reference state is a state where the abutting portion 90*c* of the ejection arm 90 is in the position not to push out the toner cartridge 32 in the housed position. That is, the abutting portion 90*c* of the ejection arm 90 is positioned on the rear side of the end portion on the rear side of the toner cartridge 32 in the housed position.

Next, the ejection (pushing-out) action of the ejection mechanism 80 will be described. Here, the ejection action is an action in which the toner cartridge 32 is pushed out from the housed position to the extractable position (in the direction in which the toner cartridge 32 is extracted from the cartridge housing portion 52) by the ejection mechanism 80.

The ejection action is performed by an instruction by the CPU of the control portion. The ejection action is performed only in the case where it is determined that the toner cartridge 32 has to be replaced. A case where the toner cartridge 32 has to be replaced is a case where the toner in the toner cartridge 32 becomes less than a prescribed amount, a case where refilling failure of the toner occurs in the toner cartridge 32, a case where an incorrect toner cartridge is inserted in the cartridge housing portion 52, or the like, for example.

Accordingly, the ejection action is not performed in a case where the toner cartridge 32 does not have to be replaced. In such a situation, the usual toner conveyance action is performed. As described above, in a case where the usual toner conveyance action is performed, the motor 72 of the driving unit 70 is rotated forward. In this case, as described above, the rotational driving force of the motor 72 is transmitted to the auger screw via the drive transmission member 74 and is transmitted to the stirring member via the drive transmission member 76. Accordingly, the toner in the toner cartridge 32 is conveyed and stirred. In this case, the rotational driving force of the motor 72 is also transmitted to the one-way clutch 84 via the drive transmission member 82. However, as described above, the one-way clutch 84 does not transmit the rotational driving force to the ejection cam 86 in a case where the motor 72 is rotated forward. Accordingly, in the usual toner conveyance action, the ejection cam 86 does not rotate, and the ejection lever 88 or the ejection arm 90 thus does not move. That is, the reference states are maintained.

On the other hand, in a case where it is determined that the toner cartridge 32 has to be replaced, the ejection action is performed. In a case where the ejection action is performed, the motor 72 of the driving unit 70 is rotated reversely. In a case where the motor 72 is rotated reversely, as described above, the one-way clutch 84 transmits the rotational driving force of the motor 72 to the ejection cam 86. Here, the rotational angle of the motor 72 of the driving unit 70 in the ejection action is set such that the ejection cam 86 performs one rotation.

Figure 7B:
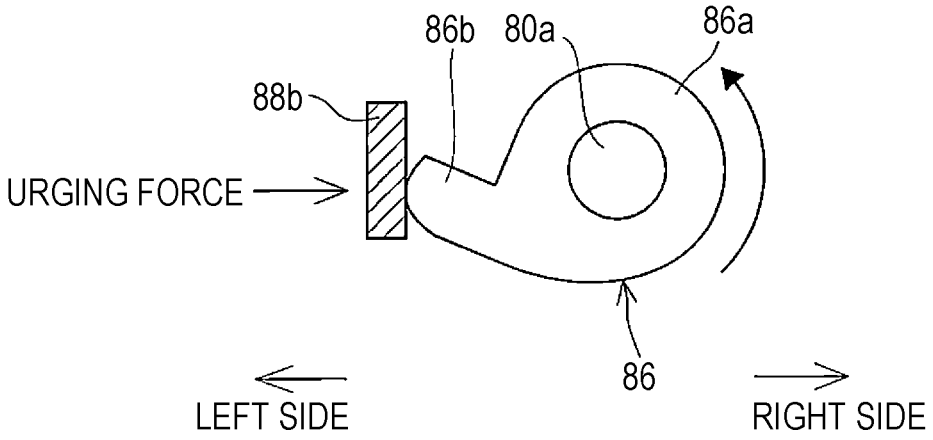
FIG. 7B is an explanatory diagram that illustrates the configuration of the ejection cam and the ejection lever in the ejection state as seen from the front side.

FIG. 7B is an explanatory diagram that illustrates the configuration of the ejection cam 86 in an ejection state. As illustrated in FIG. 7B, in a case where the rotational driving force is transmitted, the ejection cam 86 performs one rotation in the counterclockwise direction as seen from the front side. Here, in the middle of one rotation of the ejection cam 86, the left side surface of the abutting portion 88*d* of the ejection lever 88 moves up on the protrusion portion 86*b*. In a case where the left side surface of the abutting portion 88*d* of the ejection lever 88 moves up on the protrusion portion 86*b*, the abutting portion 88*d* of the ejection lever 88 is moved to the left side.

Figure 8:
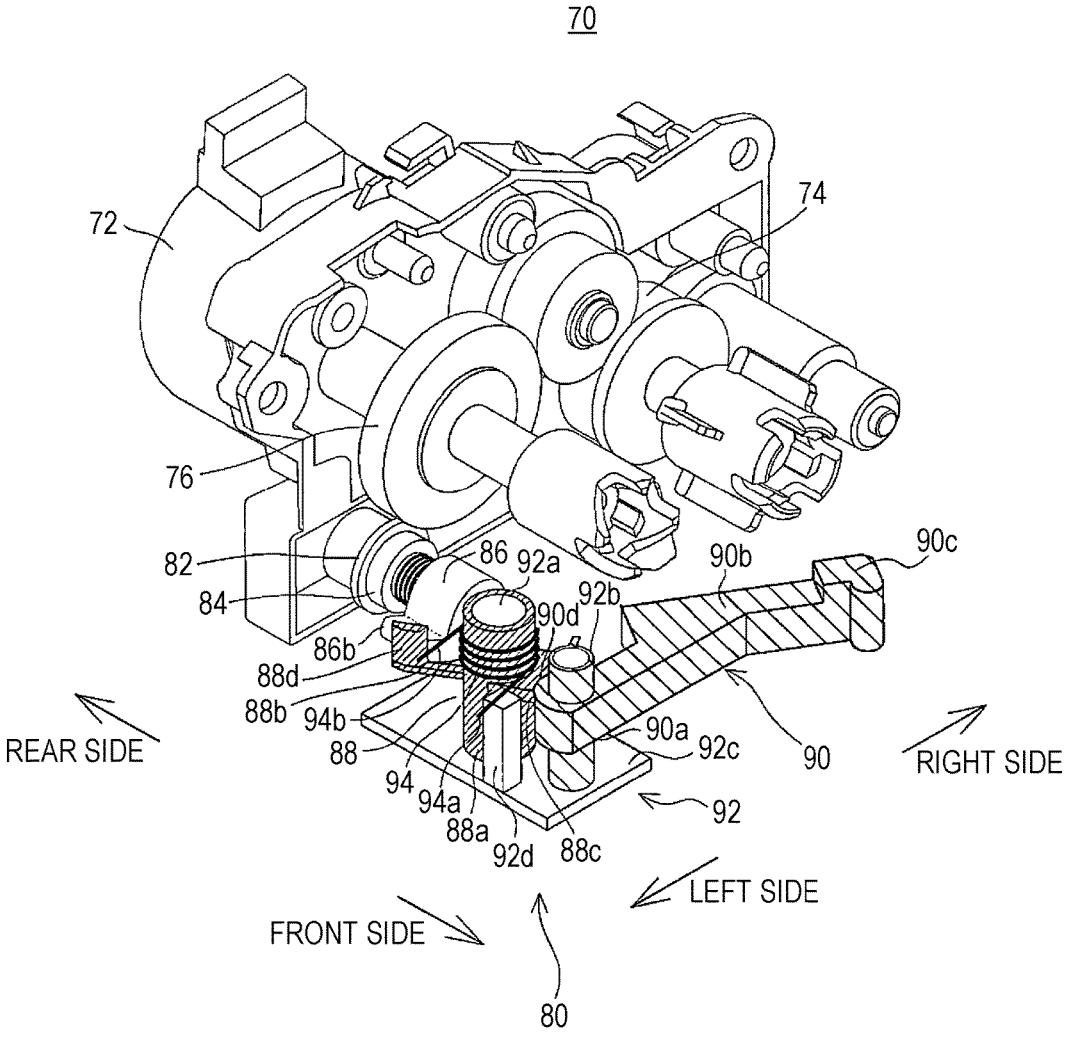
FIG. 8 is a perspective diagram that illustrates the configuration of the driving unit in a case where an ejection action is performed.

FIG. 6B is the explanatory diagram that illustrates the configuration of the ejection mechanism 80 in the ejection state as seen from the upper side. FIG. 8 is a perspective diagram that illustrates the configuration of the driving unit 70 in a case where the ejection action is performed. As illustrated in FIG. 6B and FIG. 8, in a case where the abutting portion 88*d* of the ejection lever 88 is moved to the left side, the ejection lever 88 pivots in the counterclockwise direction as seen from the upper side against the urging force of the spring 94. In a case where the ejection lever 88 pivots in the counterclockwise direction as seen from the upper side, the rotational force in the opposite direction (clockwise direction) is transmitted to the ejection arm 90. Accordingly, the ejection arm 90 pivots in the clockwise direction as seen from the upper side.

In a case where the ejection arm 90 pivots in the clockwise direction as seen from the upper side, the abutting portion 90*c* moves from the rear side to the front side (for example, 15 to 20 mm). In this case, in a case where the toner cartridge 32 is in the housed position, the abutting portion 90*c* pushes out the toner cartridge 32 to the front side. In a case where the toner cartridge 32 is pushed out to the front side, the end portion on the front side of the toner cartridge 32 protrudes to the front side of the opening 52*a* of the cartridge housing portion 52. That is, the toner cartridge 32 is moved to the extractable position.

Such a state of the ejection mechanism 80 in a case where the abutting portion 90*c* moves to the front side will be referred to as the ejection state. Further, the distance in which the toner cartridge 32 is pushed out to the front side by the abutting portion 90*c* will be referred to as an ejection amount.

Further, the ejection amount is set shorter than the distance (gap) between the end portion on the front side of the toner cartridge 32 in the housed state (the front surface of the front cover 62) and the lid 10*b* of the device body 10*a* in the closed state. This setting is made so that the end portion on the front side of the toner cartridge 32 that is pushed out to the front side by the ejection action does not collide with the lid 10*b* of the device body 10*a*.

In addition, in a case where the ejection cam 86 performs one rotation, the abutting portion 88*d* of the ejection lever 88 moves over the protrusion portion 86*b* and is thereafter moved to the right side by the urging force of the spring 94. That is, the reference states are recovered. In a case where the reference states are recovered, the abutting portion 90*c* of the ejection arm 90 moves from the front side to the rear side. Here, because the abutting portion 90*c* is not coupled with the toner cartridge 32, the toner cartridge 32 is maintained in the extractable position. Accordingly, after the ejection action is performed, the user may extract the toner cartridge 32.

In the image forming device 10 in such a configuration, in a case where the toner in the toner cartridge 32 runs out, the ejection mechanism 80 acts automatically or in accordance with an operation by the user or the like, and the toner cartridge 32 is pushed out to the front side as described above. That is, in the image forming device 10, in a case where replacement or the like of the toner cartridge 32 is performed, it is assumed that the toner cartridge 32 is pushed out to the front side by the ejection mechanism 80.

Thus, there is a problem that the toner cartridge 32 that is only manually extractable may not be used and flexibility of product marketing is low after the image forming device 10 is on sale. A simple expression of "manually" herein means an action that is performed by a hand of the user or the like without using the ejection mechanism 80.

Accordingly, in the first embodiment, a configuration is made such that whether the toner cartridge 32 is extractable by the ejection mechanism 80 may be distinguished. In accordance with a distinction result, the action of the ejection mechanism 80 is controlled.

The image forming device 10 of the first embodiment will specifically be described below. In the first embodiment, the CRUM chip stores specific information (ejection permission information) about whether the ejection action by the ejection mechanism 80 for the toner cartridge 32 is possible (whether permitted). The ejection permission information is stored when the toner cartridge 32 is manufactured.

That is, the toner cartridge 32 that is used for the image forming device 10 of the first embodiment may be categorized into a toner cartridge (hereinafter referred to as "permitting cartridge") that permits the ejection action and a toner cartridge (hereinafter referred to as "inhibiting cartridge") that inhibits the ejection action.

Here, the permitting cartridge is in the same configuration as the toner cartridge 32 that is used for the above-described image forming device 10 in related art. Accordingly, in a case where the permitting cartridge is in the housed position, the user may not grip an end portion on a front side of the permitting cartridge. Thus, the permitting cartridge in the housed position is not extracted from the cartridge housing portion 52, or extraction is difficult. That is, the permitting cartridge is moved from the housed position to the extractable position only by the ejection action.

Figure 9:
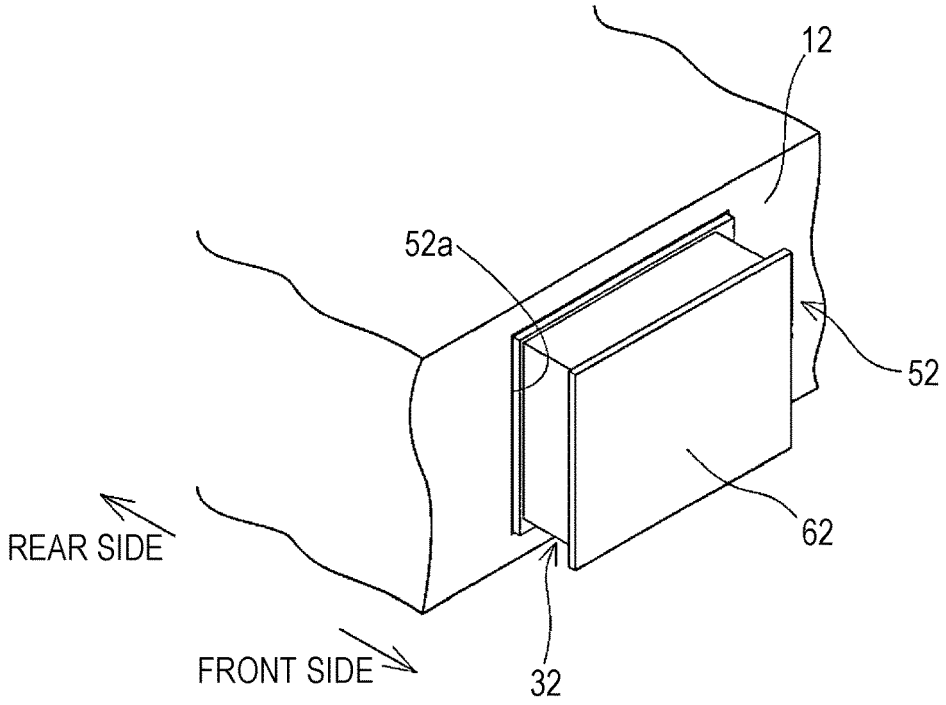
FIG. 9 is an explanatory diagram that illustrates a configuration of an inhibiting cartridge.

FIG. 9 is an explanatory diagram that illustrates a configuration of the inhibiting cartridge. The length of the inhibiting cartridge in the front-rear direction is set longer than the permitting cartridge. Thus, as illustrated in FIG. 9, in a case where the inhibiting cartridge is in the housed position, an end portion on a front side of the inhibiting cartridge protrudes to the front side (outside in the horizontal direction) of the opening 52*a* of the cartridge housing portion 52. For example, the length of the inhibiting cartridge in the front-rear direction is set such that the position of the end portion on the front side of the inhibiting cartridge in the housed position becomes the same as the position of the end portion on the front side of the permitting cartridge that is moved to the extractable position. That is, in a case where the inhibiting cartridge is in the housed position, the end portion on the front side of the inhibiting cartridge protrudes to the front side by approximately 15 to 20 mm from the opening 52*a* of the cartridge housing portion 52.

Accordingly, even in a case where the inhibiting cartridge is in the housed position, the user may grip the end portion on the front side of the inhibiting cartridge. That is, the inhibiting cartridge even in the housed position is extractable.

Further, in the first embodiment, whether or not the ejection action is possible is determined in accordance with the ejection permission information stored in the CRUM chip of the toner cartridge 32.

In a case where the toner cartridge 32 is housed in the cartridge housing portion 52, the CPU of the control portion reads out the ejection permission information stored in the CRUM chip of the toner cartridge 32. Then, a determination is made whether the toner cartridge 32 is the permitting cartridge (or the inhibiting cartridge).

For example, in a case where it is determined that the toner cartridge 32 housed in the cartridge housing portion 52 is the permitting cartridge, the ejection action in related art is performed. On the other hand, in a case where it is determined that the toner cartridge 32 housed in the cartridge housing portion 52 is the inhibiting cartridge (a case where it is determined that the toner cartridge 32 is not the permitting cartridge), the ejection action is not performed for the toner cartridge 32. That is, the ejection action is inhibited.

As described above, in the first embodiment, the ejection action by the ejection mechanism 80 is permitted for the permitting cartridge, and the ejection action is inhibited for the inhibiting cartridge. Thus, both of the permitting cartridge and the inhibiting cartridge may be used. Therefore, usable kinds of the toner cartridges 32 may be increased, and the flexibility of product marketing of the toner cartridge 32 at a time after the image forming device 10 is on sale may be enhanced.

[Second Embodiment]

The image forming device 10 of a second embodiment is different from the above-described first embodiment in a point that the image forming device 10 of the second embodiment includes two kinds of permitting cartridges and either one of two kinds of ejection modes in which ejection action is executed in different conditions is set for each of the permitting cartridges. Because the other configurations are similar, the same reference characters are given to the common portions to the above-described first embodiment, and repeated descriptions will not be made or will be simplified.

The image forming device 10 of the second embodiment includes two kinds of permitting cartridges. Specifically, in the image forming device 10 of the second embodiment, the two kinds of permitting cartridges include a first permitting cartridge and a second permitting cartridge.

Here, the first permitting cartridge is in the same configuration as the permitting cartridge that is described in the first embodiment. Thus, the first permitting cartridge is moved from the housed position to the extractable position only by the ejection action.

Figure 10:
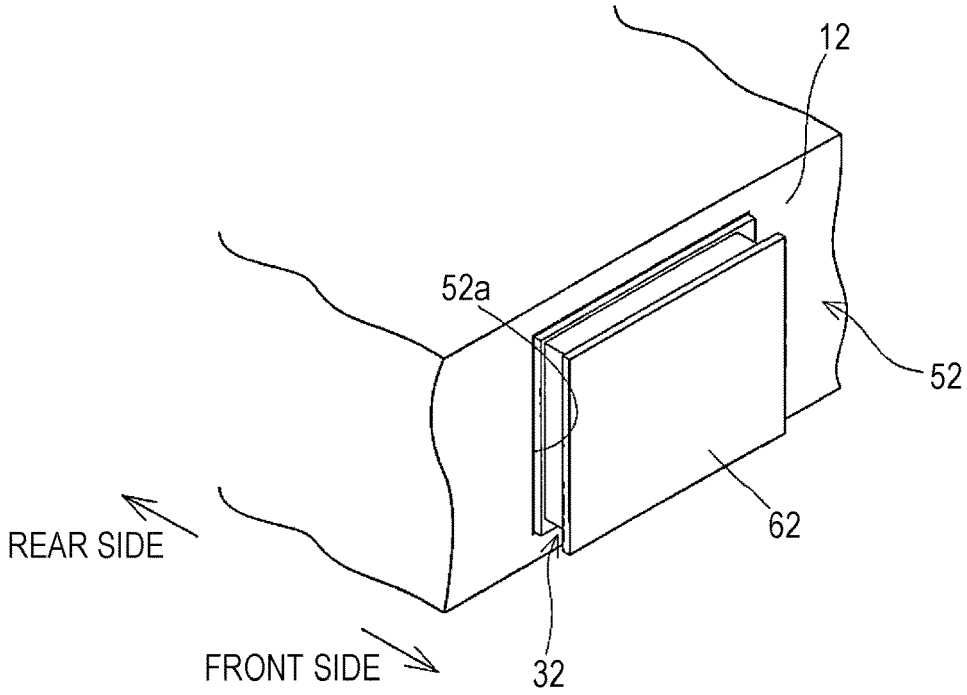
FIG. 10 is an explanatory diagram that illustrates a configuration of a second permitting cartridge in a second embodiment.

FIG. 10 is an explanatory diagram that illustrates a configuration of the second permitting cartridge in the second embodiment. The length of the second permitting cartridge in the front-rear direction is set longer than the first permitting cartridge. Thus, as illustrated in FIG. 10, in a case where the second permitting cartridge is in the housed position, an end portion on a front side of the second permitting cartridge protrudes to the front side of the opening 52*a* of the cartridge housing portion 52. Accordingly, even in a case where the second permitting cartridge is in the housed position, the user may grip the end portion on the front side of the second permitting cartridge.

Here, the length of the second permitting cartridge in the front-rear direction is set shorter than the above-described inhibiting cartridge. Further a gap in the front-rear direction between the end portion on the front side of the second permitting cartridge in a case where the second permitting cartridge is in the housed position and the lid 10*b* of the device body 10*a* is set longer (for example, 20 mm) than the ejection amount of the ejection action. This setting is made so that the end portion on the front side of the second permitting cartridge does not collide with the lid 10*b* of the device body 10*a* in a case where the ejection action is performed.

For example, the length of the second permitting cartridge in the front-rear direction is set approximately 5 mm longer than the first permitting cartridge and is set approximately 10 mm shorter than the inhibiting cartridge. In this case, in a case where the second permitting cartridge is in the housed position, the end portion on the front side of the second permitting cartridge protrudes to the front side of the opening 52*a* of the cartridge housing portion 52 by approximately 5 mm. A protrusion amount of the end portion on the front side of the second permitting cartridge is shorter (approximately 15 to 20 mm) than the protrusion amount of the end portion on the front side of the inhibiting cartridge. Thus, even in a case where the second permitting cartridge is in the housed position, the user may grip the end portion on the front side of the second permitting cartridge. However, it is more difficult to grip the second permitting cartridge than the inhibiting cartridge.

Next, the ejection action in the second embodiment will be described. In the second embodiment, an automatic ejection mode and a manual ejection mode are set. The automatic ejection mode and the manual ejection mode are modes that execute ejection actions (actuate the ejection mechanism 80) in respective different conditions.

In a case where the automatic ejection mode is set and where it is determined that the toner cartridge 32 has to be replaced, the ejection action is performed by an instruction by the CPU of the control portion. That is, the ejection action is automatically performed without involvement of the user.

On the other hand, in the manual ejection mode, the ejection action is performed in a case where the manual ejection mode is set. Specifically, the manual ejection mode is set in a case where the user who uses the image forming device 10 operates the operating panel and inputs an instruction of the ejection action. Although not illustrated, in the second embodiment, the operating panel is provided with software keys or hardware keys for performing the instruction of the ejection action.

In a case where the manual ejection mode is set, the ejection action is performed even in a case where the toner cartridge 32 does not have to be replaced. That is, in the manual ejection mode, the ejection action is performed in accordance with an operation by the user regardless of other conditions such as whether or not the toner cartridge 32 has to be replaced. That is, the user may manually perform the instruction of the ejection action.

Further, in the second embodiment, the ejection permission information stored in the CRUM chip of the permitting cartridge includes either one of first ejection permission information that indicates that the ejection action is permitted under a prescribed condition and second ejection permission information that indicates the ejection action is permitted under a different condition from the condition of the first ejection permission information.

Here, the first ejection permission information is information that indicates that setting of the automatic ejection mode and the manual ejection mode is permitted. Meanwhile, the second ejection permission information is information that indicates that setting of the automatic ejection mode is inhibited and setting of the manual ejection mode is permitted.

In the second embodiment, the CRUM chip provided to the first permitting cartridge stores the first ejection permission information. Accordingly, the first permitting cartridge permits setting of the automatic ejection mode and the manual ejection mode.

Meanwhile, the CRUM chip provided to the second permitting cartridge stores the second ejection permission information. Accordingly, the second permitting cartridge inhibits setting of the automatic ejection mode and permits setting of the manual ejection mode.

In the second embodiment, the two kinds of permitting cartridges may be used. Thus, usable kinds of the toner cartridges 32 for the image forming device 10 may further be increased, and the flexibility of product marketing of the toner cartridge 32 at a time after the image forming device 10 is on sale may be enhanced.

Further, because the second permitting cartridge even in the housed position may be extracted from the cartridge housing portion 52 by the user, the toner cartridge 32 may be extracted at a timing when the user desires to replace the toner cartridge 32. In addition, because it is more difficult to grip the second permitting cartridge in the housed position than the inhibiting cartridge, extraction of the toner cartridge 32 by accident may be avoided.

In addition, the manual ejection mode is set, and the ejection action is thereby performed in accordance with an operation by the user regardless of whether or not the toner cartridge 32 has to be replaced. Thus, the toner cartridge 32 may be moved to the extractable position at a timing when the user desires to replace the toner cartridge 32 and is highly convenient.

[Third Embodiment]

The image forming device 10 of a third embodiment is different from the above-described first embodiment in a point that two kinds of ejection actions in which the ejection amounts are different are set. Because configurations of the other portions are similar, the same reference characters are given to the common portions to the above-described first embodiment, and repeated descriptions will not be made or will be simplified.

Figure 11A:
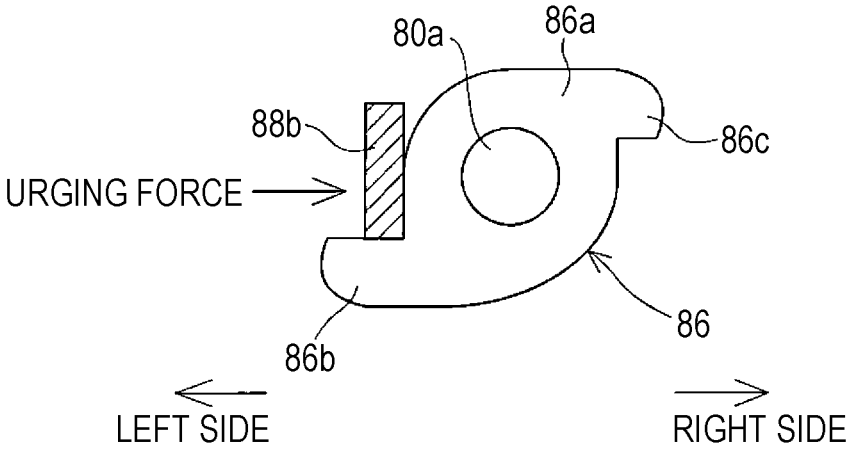
FIG. 11A is an explanatory diagram that illustrates a configuration of the ejection cam and the ejection lever in a third embodiment as seen from the front side.
Figure 11B:
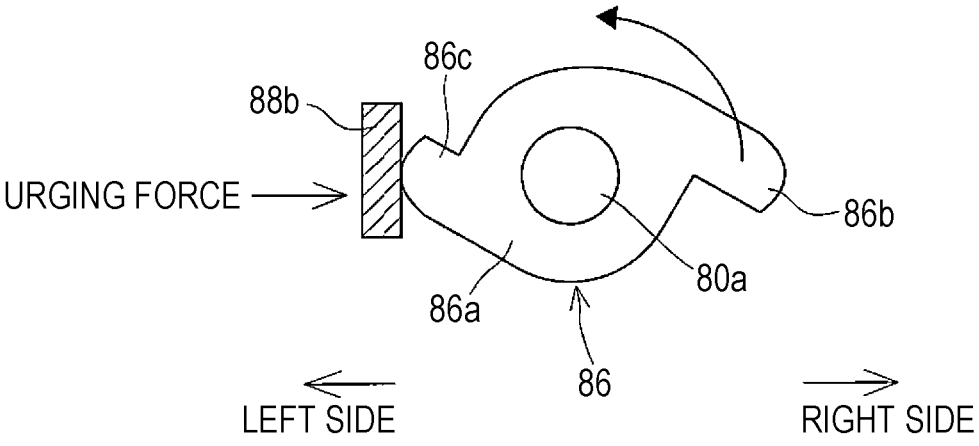
FIG. 11B is an explanatory diagram that illustrates the configuration of the ejection cam and the ejection lever in the third embodiment in the ejection state as seen from the front side.

FIG. 11A is an explanatory diagram that illustrates a configuration of the ejection cam 86 and the ejection lever 88 in the third embodiment as seen from the front side. FIG. 11B is an explanatory diagram that illustrates the configuration of the ejection cam 86 and the ejection lever 88 in a first ejection action in the third embodiment as seen from the front side.

In the third embodiment, the ejection cam 86 is provided with a protrusion portion 86*c* (corresponding to a second pushing-out member) that is different from the protrusion portion 86*b* (corresponding to a first pushing-out member). Similarly to the protrusion portion 86*b*, the protrusion portion 86*c* protrudes in the tangential direction of the outer peripheral surface of the base portion 86*a*.

When seen from the front side, the protrusion portion 86*b* and the protrusion portion 86*c* are provided in separate positions in the circumferential direction. In the third embodiment, as illustrated in FIG. 11A, the protrusion portion 86*b* and the protrusion portion 86*c* are provided in point-symmetric positions with respect to the axial line of the shaft member 80*a* as the center. The protrusion portion 86*b* is provided in the same position as the first embodiment.

Further, the protrusion height (protrusion amount) of the protrusion portion 86*c* from the outer peripheral surface of the base portion 86*a* is set lower than the protrusion height of the protrusion portion 86*b*. For example, the protrusion height of the protrusion portion 86*c* is set to approximately half the height of the protrusion height of the protrusion portion 86*b*. Note that it is sufficient that the protrusion height of the protrusion portion 86*c* is lower than the height of the protrusion height of the protrusion portion 86*b*, and the protrusion height may appropriately be changed.

In the third embodiment, in a case where the ejection action is performed and where the ejection cam 86 is rotated counterclockwise, the left side surface of the abutting portion 88*d* of the ejection lever 88 moves up on the protrusion portion 86*c* earlier than the protrusion portion 86*b*. For example, until the ejection cam 86 rotates counterclockwise by 180° (half a rotation), the left side surface of the abutting portion 88*d* of the ejection lever 88 moves up on the protrusion portion 86*c*. Here, the action in which the left side surface of the abutting portion 88*d* of the ejection lever 88 moves up on the protrusion portion 86*c* will be referred to as the first ejection action.

Further, in a case where the ejection cam 86 performs one counterclockwise rotation, the abutting portion 88*d* of the ejection lever 88 moves over the protrusion portion 86*c* and thereafter moves up on the protrusion portion 86*b*. Here, the action in which the left side surface of the abutting portion 88*d* of the ejection lever 88 moves up on the protrusion portion 86*b* will be referred to as the second ejection action.

As described above, because the protrusion height of the protrusion portion 86*c* is set lower than the protrusion height of the protrusion portion 86*b*, the leftward movement amount of the abutting portion 88*d* of the ejection lever 88 in the first ejection action is smaller than the leftward movement amount of the abutting portion 88*d* of the ejection lever 88 in the action (second ejection action) in a case where the abutting portion 88*d* of the ejection lever 88 moves up on the protrusion portion 86*b*.

As the leftward movement amount of the abutting portion 88*d* of the ejection lever 88 is smaller, the rotational angle of the ejection lever 88 in the counterclockwise direction as seen from the upper side also becomes smaller. In this case, the rotational angle of the ejection arm 90 in the clockwise direction as seen from the upper side also becomes smaller. As the rotational angle of the ejection arm 90 in the clockwise direction as seen from the upper side becomes smaller, the movement amount of the abutting portion 90*c* from the rear side to the front side becomes smaller.

Accordingly, the ejection amount of the first ejection action is smaller than the ejection amount of the second ejection action. That is, the different in the ejection amount is decided in accordance with the protrusion heights of the protrusion portion 86*b* and the protrusion portion 86*c*. As the protrusion heights of the protrusion portion 86*b* and the protrusion portion 86*c* are lower, the ejection amounts become smaller. As the protrusion heights of the protrusion portion 86*b* and the protrusion portion 86*c* are higher, the ejection amounts become larger. In the third embodiment, because the protrusion height of the protrusion portion 86*c* is approximately half the height of the protrusion height of the protrusion portion 86*b*, the ejection amount of the first ejection action is approximately half the ejection amount of the second ejection action.

Here, the position of the toner cartridge 32 that is moved in the first ejection action will be referred to as a first extractable position. Further, the position of the toner cartridge 32 that is moved in the second ejection action will be referred to as a second extractable position. For example, in the first extractable position, the end portion on the front side of the toner cartridge 32 protrudes to the front side by approximately 10 mm from the opening 52*a* of the cartridge housing portion 52. Further, for example, in the second extractable position, the end portion on the front side of the toner cartridge 32 protrudes to the front side by approximately 20 mm from the opening 52*a* of the cartridge housing portion 52. That is, the second extractable position is set on a front side (a distant position from the housed position) of the first extractable position.

As described above, in a case where the toner cartridge 32 is in either one of the first extractable position and the second extractable position, the end portion on the front side of the toner cartridge 32 protrudes to the front side of the opening 52*a* of the cartridge housing portion 52. Accordingly, in a case where the toner cartridge 32 is in the first extractable position or the second extractable position, the user may grip the end portion on the front side of the toner cartridge 32. Here, in a case where the toner cartridge 32 is in the first extractable position, it is difficult to grip the end portion because the end portion on the front side of the toner cartridge 32 does not protrude more than a case where the toner cartridge 32 is in the second extractable position. In other words, in a case where the toner cartridge 32 is in the second extractable position, it is easy to grip the end portion because the end portion on the front side of the toner cartridge 32 protrudes more than a case where the toner cartridge 32 is in the first extractable position.

As described above, in the third embodiment, the two kinds of ejection actions in which the ejection amounts are different are set. That is, in the ejection action, whether performing the first ejection action in which the toner cartridge 32 is moved to the first extractable position or the second ejection action in which the toner cartridge 32 is moved to the second extractable position may be selected.

For example, in a case where the specific information stored in the CRUM chip includes information about the length of the toner cartridge 32 in the front-rear direction, the ejection amount may be set in accordance with the length of the toner cartridge 32. In this case, in a case where the toner cartridge 32 is comparatively long and it is determined that the toner cartridge 32 collides with the lid 10*b* when moved to the second extractable position, the ejection amount is set such that the toner cartridge 32 is moved to the first extractable position. Further, a setting (selecting) screen or the like of the ejection amount is presented to the user, and the user may thereby be enabled to set (select) the ejection amount.

Further, in the third embodiment, after the first ejection action is performed, in order to return the ejection lever 88 and the ejection arm 90 to the reference states without performing the second ejection action, a two-way clutch is used instead of the one-way clutch 84. Using the two-way clutch enables the ejection cam 86 to rotate in the opposite direction (clockwise) by 180° after the ejection cam 86 is rotated counterclockwise by 180°. In this case, after the first ejection action is performed, the reference states are recovered without causing the abutting portion 88*d* of the ejection lever 88 to moves up on the protrusion portion 86*b*. Accordingly, the toner cartridge 32 is maintained in the first extractable position. In a case where the usual toner conveyance action is performed, the two-way clutch is set not to transmit the rotational driving force of the motor 72 to the ejection cam 86.

In the third embodiment, because the two kinds of ejection actions in which the ejection amounts are different are set, the toner cartridges 32 with different lengths in the front-rear direction may be used in combination. Therefore, usable kinds of the toner cartridges 32 may be increased, and the flexibility of product marketing of the toner cartridge 32 at a time after the image forming device 10 is on sale may be enhanced.

Note that the modes described in the third embodiment may be employed while being combined with the second embodiment. For example, because the second permitting cartridge is longer than the first permitting cartridge in the front-rear direction, it may be considered that setting is made to perform the first ejection action with the small ejection amount for the second permitting cartridge.

Further, in the above-described embodiments, a description is made in which the toner cartridge is raised as an example of the consumable article container. However, the consumable article container is not limited to the toner cartridge but may be a toner bottle. In addition, as the toner that is the consumable article, liquid toner may also be used. In this case, the consumable article container is a liquid toner container. Furthermore, in the above-described embodiments, a description is made in which the image forming device 10 of an electrophotographic scheme is raised as an example. However, embodiments do not have to be limited to this. In a case of the image forming device 10 of an ink-jet type, the consumable article is ink. Thus, the consumable article container that houses the ink as the consumable article is an ink cartridge or an ink bottle.

In addition, in the above-described embodiments, the toner cartridge 32 is provided with the storage member that stores the specific information (ejection permission information) about whether the ejection action by the ejection mechanism 80 for the toner cartridge 32 is possible. However, embodiments do not have to be limited to this. The storage member that stores the ejection permission information may be provided to the image forming device 10. In this case, the memory of the control portion of the image forming device 10 stores table data in which the identification information of the toner cartridge 32 is associated with the ejection permission information. Thus, the CPU of the control portion of the image forming device 10 refers to the table data and thereby determines whether or not the ejection action is possible in accordance with the ejection permission information that is associated with the identification information of the toner cartridge 32. The table data may be updated periodically. For example, in a case where the image forming device 10 includes a communication portion for communicating with the outside, the table data are updated via the Internet and so forth. Further, in a case where the image forming device 10 includes a connection portion (socket) for connection with a recording medium such as a USB, the table data are updated by using data in the recording medium in a case of maintenance or the like.

Furthermore, the techniques of the present disclosure have been described based on the specific embodiments. However, the techniques of the present disclosure are not limited to the above-described embodiments. Any of the specific embodiments raised above is merely one example, and embodiments may appropriately be changed in accordance with requests such as specifications of products.

The present disclosure contains subject matter related to that disclosed in Japanese Priority Patent Application JP 2016-114349 filed in the Japan Patent Office on Jun. 8, 2016, the entire contents of which are hereby incorporated by reference.

It should be understood by those skilled in the art that various modifications, combinations, sub-combinations and alterations may occur depending on design requirements and other factors insofar as they are within the scope of the appended claims or the equivalents thereof.

What is claimed is:

1. An image forming device that forms an image on paper by using a consumable article, the image forming device comprising:

a consumable article container housing portion that is provided to a device body;

a consumable article container that is housed in the consumable article container housing portion so as to be capable of insertion and pulling-out;

a storage member that is provided in the consumable article container or the image forming device and stores specific information about whether the consumable article container is extractable at a housed position where the consumable article container is housed in the consumable article container housing portion; and a pushing-out unit that pushes out the consumable article container in a direction in which the consumable article container is pulled out from the consumable article container housing portion when the specific information which is stored in the storage member indicates that the consumable article container is non-extractable at the housed position.

2. The image forming device according to claim 1, further comprising:

a plurality of consumable article container housing portions; and a plurality of consumable article containers, wherein the plurality of consumable article containers include the consumable article container for which a pushing-out action is permitted by the pushing-out unit and the consumable article container for which the pushing-out action is inhibited.

3. The image forming device according to claim 1, wherein the specific information includes first ejection permission information in which a pushing-out action by the pushing-out unit is permitted under a prescribed condition or second ejection permission information in which the pushing-out action is permitted under a different condition from the condition of the first permission information, and the pushing-out unit performs the pushing-out action under the prescribed condition for the consumable article container in which the first ejection permission information is stored in the storage member and performs the pushing-out unit under the different condition for the consumable article container in which the second ejection permission information is stored in the storage member.

4. The image forming device according to claim 1, wherein the image forming device includes a first extractable position that is set farther than the housed position in the direction in which the consumable article container is pulled out from the consumable article container housing portion, and a second extractable position that is set still farther than the first extractable position in the direction in which the consumable article container is pulled out from the consumable article container housing portion;

the pushing-out unit includes a first pushing-out member that pushes out the consumable article container from the housed position to the first extractable position and a second pushing-out member that pushes out the consumable article container from the housed position to the second extractable position;

the specific information includes information about a length of the consumable article container in the direction in which the consumable article container is pulled out from the consumable article container housing portion; and the pushing-out unit performs the pushing-out action by using the first pushing-out member in a case where the information about the length of the consumable article container indicates that the length of the consumable article container is equal to or more than a prescribed length, and performs the pushing-out action by using the second pushing-out member in a case where the information about the length of the consumable article container indicates that the length of the consumable article container is less than the prescribed length.

5. The image forming device according to claim 1, wherein a position of the consumable article container after the pushing out action is performed by the pushing-out unit is set based on the specific information.

6. The image forming device according to claim 1, wherein a position of the consumable article container after the pushing out action is performed by the pushing-out unit is a position that an end portion on a front side of the consumable article container protrudes to the front side of an opening of the consumable article container housing portion.

7. The image forming device according to claim 1, wherein the specific information includes information about a length of the consumable article container in the direction in which the consumable article container is pulled out from the consumable article container housing portion in the consumable article container concerned, and a position of the consumable article container after the pushing out action is performed by the pushing-out unit is set based on the information about the length of the consumable article container.

8. The image forming device according to claim 1, wherein the pushing-out unit is configured to selectively perform a first pushing out action and a second pushing out action that pushing out amounts are different from each other.

9. The image forming device according to claim 1, further comprising a motor capable of being switched between forward rotation and reverse rotation; and a conveying member which is rotated by a rotation driving force transmitted from the motor, and conveys the consumable article contained in the consumable article container in a prescribed conveying direction at least a case where the motor is driven in the forward rotation, wherein the pushing-out unit includes a pushing-out member which is coupled to the motor via a one-way clutch which is rotated only in a case where the motor is driven in the reverse rotation, and pushes out the consumable article container when receiving the rotation driving force transmitted by the one-way clutch.

* * * * *